United States Patent [19]

Ueng

[11] Patent Number: 4,955,601

[45] Date of Patent: Sep. 11, 1990

[54] ALL-OCCASION ROPE

[76] Inventor: Ming-Shean Ueng, P.O. Box 396, Phillisburg, N.J. 08869

[21] Appl. No.: 182,835

[22] Filed: Apr. 18, 1988

[51] Int. Cl.[5] ..... A63B 5/20

[52] U.S. Cl. ..... 272/75; 272/74; 272/143

[58] Field of Search ..... 272/74, 75

[56] References Cited

U.S. PATENT DOCUMENTS

| | | | |
|---|---|---|---|
| 623,698 | 4/1899 | Beckh | 272/75 |
| 2,253,075 | 8/1941 | Johnson | 272/75 |
| 2,869,872 | 1/1959 | Nissen | 272/75 |
| 4,177,985 | 12/1979 | Hlasnicek et al. | 272/75 |

FOREIGN PATENT DOCUMENTS

| | | | |
|---|---|---|---|
| 263999 | 9/1949 | Switzerland | 272/75 |
| 6467 | of 1909 | United Kingdom | 272/75 |
| 1217867 | 12/1970 | United Kingdom | 272/75 |

OTHER PUBLICATIONS

Popular Mechanics, 3/1979 "Rediscover the Jump Rope".

*Primary Examiner*—Richard J. Apley
*Assistant Examiner*—D. F. Crosby

[57] ABSTRACT

An all-occasion jumping rope comprises two handles, two freely rotatable holders inside the handles, a flexible rope, a flexible string free slidable inside the rope, a structure to hold the flexible rope to allow the twisting of rope to transfer to the free rotatable ends and structure to adjust the length of the string to change the length of the rope so that all people of different height including growing children can use it all the time without buying a new rope of longer length.

12 Claims, 3 Drawing Sheets

FIG. 1
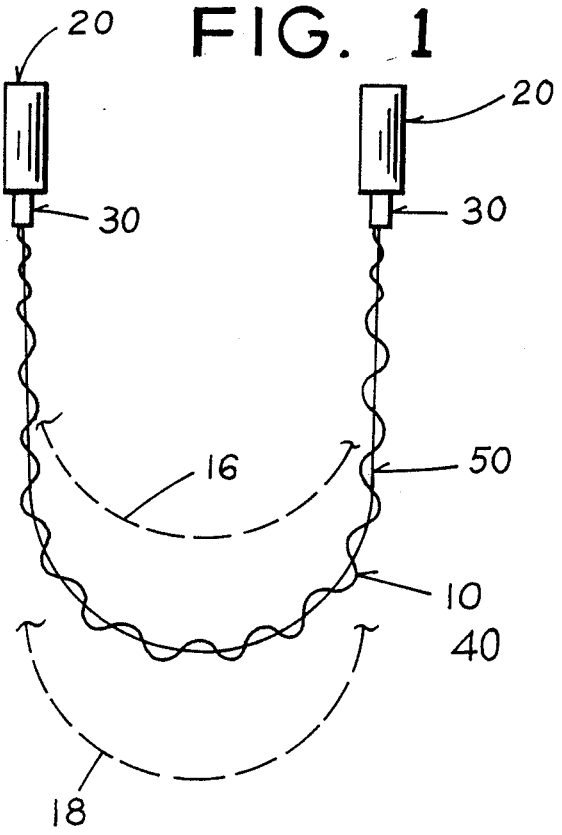
FIG. 2
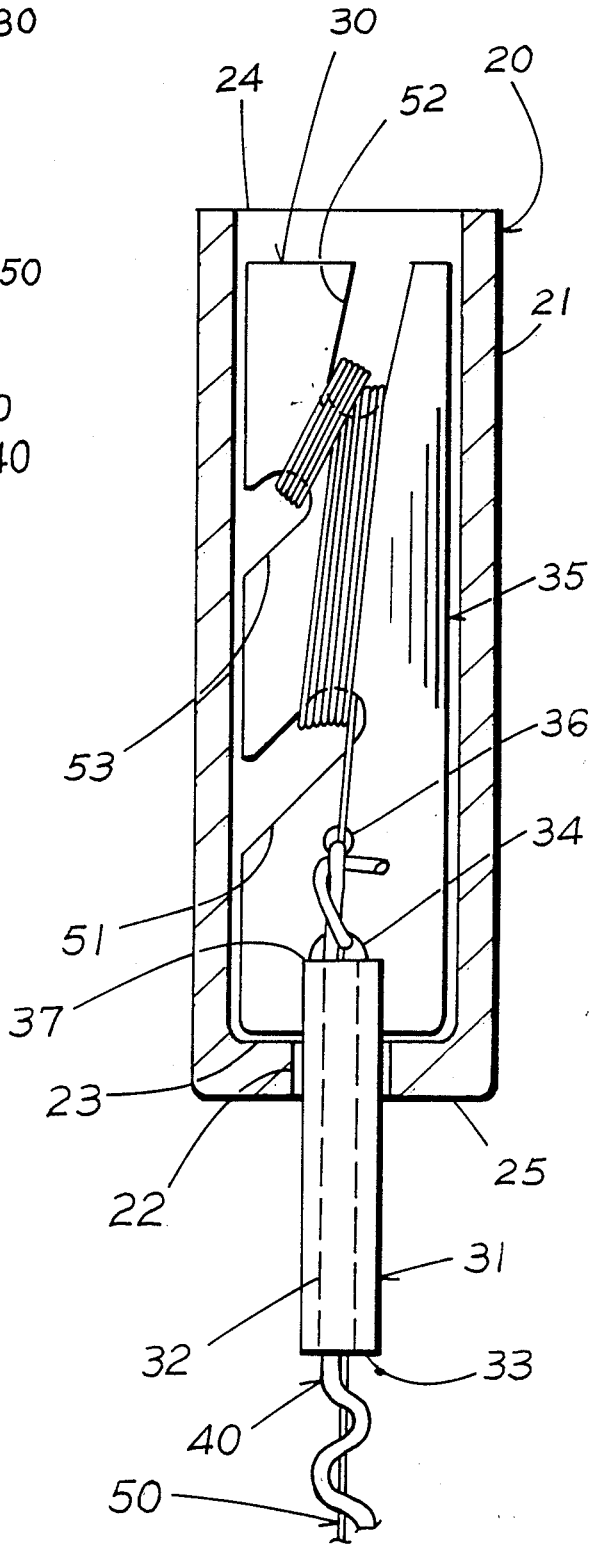
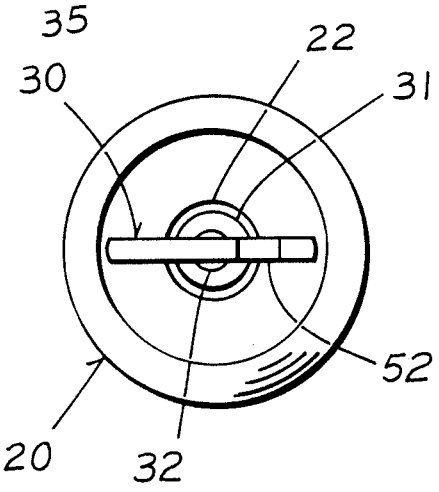
FIG. 3

ALL-OCCASION ROPE

BACKGROUND OF THE INVENTION

This invention relates to a jumping rope. The existing jumping rope on the market is a kind of fixed length once a specific length is made. For a growing child with changing height, it is quite often to buy a new jumping rope in order to get a longer length. Even so, a jumping rope of fixed length can not be used by other people having different heights. When the rope is to be held by two people instead of one for group playing, it also needs a much longer length.

Therefore, to save money and allow all people to join the play to have fun, an all-occasion jumping rope is invented to adjust the length to meet the requirements of different heights of all people, such as family members with growing children, schoolmates, classmates and neighbors.

DESCRIPTION OF THE DRAWING

The objects, characteristics and advantages of this invention will be more fully understood from the accompanying drawings, in which:

FIG. 1 is a front view of the most preferred embodiment of all-occasion jumping rope, FIG. 2 is an enlarged view of one of the end portions of FIG. 1, FIG. 3 is a top view of FIG. 2.

DESCRIPTION OF THE INVENTION

Figure 4:
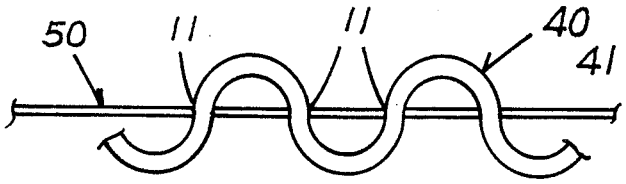
FIG. 4 is an enlarged view of the middle portion of FIG. 1.

Now, referring to FIG. 1 there is shown an all-occasion jumping rope 10 of the most preferred embodiment. The rope 10 consists of two handles 20, two holders 30, a rope 40 and a string 50 passing through the rope 40. The string 50 is attached at both ends to two holders 30 by knots or ties. Each holder 30 is free rotatable inside handle 20, so that any rotational twist on rope 40 will not transfer to handles 20. This is similar to the universal joints of a key chain which is free rotatable at all joints. The rope 40 may be attached at both ends to two holders 30, or placed between two holders 30. By changing the length of string 50, such as winding or un-winding on one or both holders 30, the pitches of the corresponding points of the corrugation of the rope 40 will be increased or decreased, thus change the length of jumping rope 10 between both ends of two holders 30. Item 16 is a shorter length of rope 10. Item 18 is a longer length of rope 10.

FIG. 2 shows details of handle 20 which consists of a tube 21 with one open end 24, and with another close end 25 having a hole 22.

The holder 30 consists of a tube 31 with a hole 32, and a body 35 which has holes 34 and 36, and notches 51, 52 and 53. The holder 30 is free rotatable inside handle 20. The rope 40 may end at lower surface 33 of holder 30 with or without a knot, or end at upper surface 37 with or without a knot or tie. The rope 40 may also be tied at holes 34 and 36. The string 50 comes out of rope 40 at lower surface 33 or upper surface 37 in front of any knot or tie of rope 40, passing through hole 36 and winding onto notches 51 and 52 for large amount of length adjustment, and notches 52 and 53 for small amount of length adjustment.

By pushing the lower surface 33 upward, the holder 30 comes out of handle 20 so that it is possible to winding or un-winding the string 50 to change the length of rope 40, and then, put it back into its original position ready for playing. The string 50 with rope 40 is attached, by a tie, to both holders 30 on notches 51 and 52 but the winding of string 50 may be on one or both holders 30. Of course, the length of tube 31 should be long enough to allow the holder 30 to be pushed out long enough to convenient the operation of winding or un-winding. Or the maximum width or height of rope 40 in its shortest length must be smaller than the hole 22 on handle 20. The outside contour of handle 20 may varies to fit the hand grip.

FIG. 3 shows handle 20 with holder 30 inside. The tube 31 of holder 30 will rotate freely in hole 22 of handle 20. The hole 32 allows string 50 with or without rope 40 to pass through. The notch 53 on body 35 of holder 30 is provided for the winding of string 50. The view is incomplete for the purpose of clarity.

FIG. 4 shows details of the first preferred embodiment 41 of rope 40 with string 50, which are all flexible. There are a plurality of small holes 11 on rope 41 for string 50 to pass through.

Figure 5:
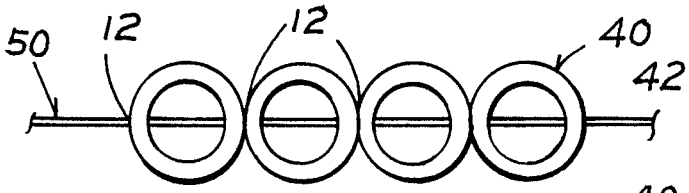
FIG. 5 is a second preferred embodiment of rope similar to FIG. 4.
Figure 5A:
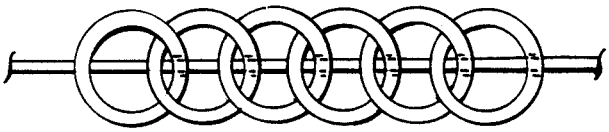

FIGS. 5 and 5A show details of the second preferred embodiment 42 of rope 40 with string 50. The rope 42 consists of a plurality of O-rings. There are two small holes 12 on each O-ring of rope 42 for string 50 to pass through. Those rings may also be made in long series, into a chain.

Figure 6:
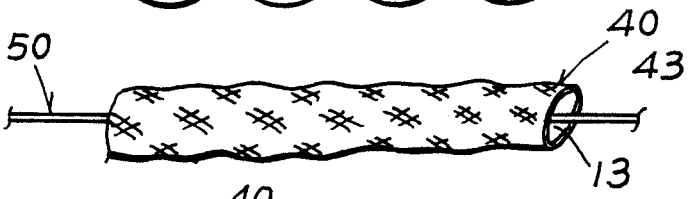
FIG. 6 is a third preferred embodiment of rope similar to FIG. 4.

FIG. 6 shows details of the third preferred embodiment 43 of rope 40 with string 50. The rope 43 may be a braided nylon rope or string or the like having string 50 passing through its hole 13 in the middle. The rope 43 of braided nylon is shortened by having the braided nylon fibers jamed together more closely. This "wrinkled" or "corrugated" rope 43 is still good for use. Also, the rope 43 may have a knot above upper surface 37 of holder 30 in FIG. 2, or have a second knot under lower surface 33, or even tied through holes 34 and 36 of holder 30.

Figure 7:
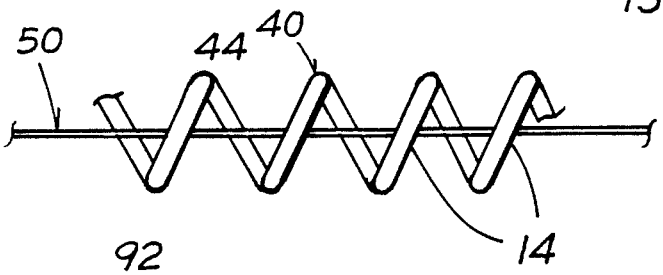
FIG. 7 is a fourth preferred embodiment of rope similar to FIG. 4.

FIG. 7 shows details of the fourth preferred embodiment 44 of rope 40 with string 50. The rope 44 may be a coiled nylon rope with or without a spring steel as a core. The string 50 passes through the center 14 of coiled rope 44.

For FIG. 4 through FIG. 7 included, a change in length of string 50 will change the length of rope 40 to meet the requirement. The pitch between two corresponding points which are not shown for clarity, decreases when string 50 is shortened. Due to some spring effect, those pitches increase when string 50 is longer. The height or width which is not shown for clarity, at both end portions of rope 40 must be smaller than the hole 22 of handle 20 when the rope 40 is in its minimum length, so that the holder 30 with rope 40 can be pushed out of handle 20 for winding or un-winding.

Figure 8:
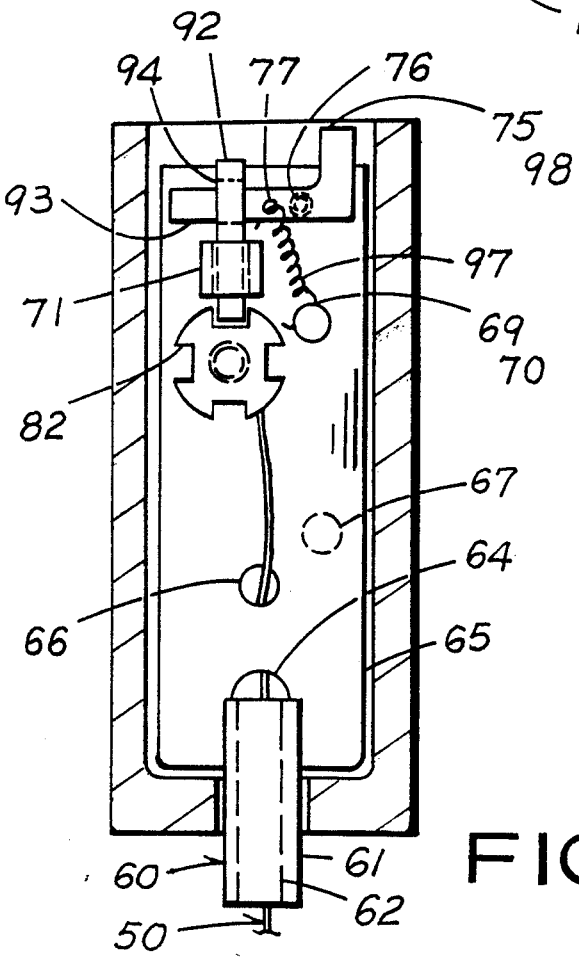
FIG. 8 is another embodiment of holder of all-occasion jumping rope.
Figure 9:
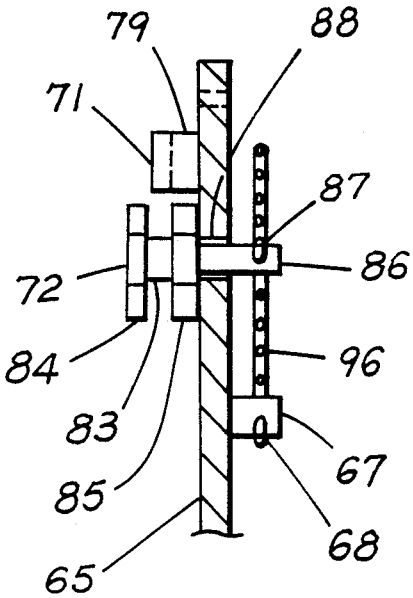
FIG. 9 is the side view of FIG. 8.

FIG. 8 and FIG. 9 show another way to adjust the length of string 50. The holder 60 has similar features as the one shown on FIG. 2. The holder 60 has a tube 61 with a long hole 62, a body 65 with holes 64 and 66, a post 67 with a hole 68 and a post 69 with a hole 70, holes 76 and 88 as hinge points, and block 71 with a long hole 72.

A roller 72 is rotatably mounted within the hole 88 on holder 60. The roller 72 has two disc 84 and 85 with a plurality of key slots 82 on at least one disk, and a neck 83 for the winding of string 50. A post 86 on roller 72 has a hole 87 for a coil spring 96 of tension type or compression type to attach to. The other end of spring 96 is attached to a hole 68 on the post 67 of holder 60.

The block 71 which is a portion of holder 60 has a long hole 79 in the middle to guide a slidable bar 92. A lever 75 rotatably mounted within hole 76 has its one end 93 passing through a slot 94 of bar 92. A tension spring 97 is attached on hole 77 of lever 75 and hole 70 of post 69. A press on a knob 98 of lever 75 lifts bar 92 to disengage from key slot 82. Thus, allows the adjustment of the length of spring 50 by winding or un-winding from roller 72. The operation of winding is accomplished by the help of spring force of coil spring 96 while pressing on knob 98 of lever 75. The operation of un-winding is accomplished by stepping the rope 40 onto the ground and lifting the handle upward while pressing on knob 98 of lever 75. The views are incomplete for the purpose of clarity.

FIG. 9 is a side view of FIG. 8. Those major parts are as shown.

To adjust the length of the flexible spring 50 it is possible to use any kinds of combination of gears having different gear ratios, spring and stop knob. However, for a simple implement with once-a-while adjustment, it is more feasible to use the device shown on FIG. 2, or one in FIG. 2 and a second one on FIG. 8. Of course, it is still feasible to use only the device shown on FIG. 8.

For string 50 to be able to slide inside the rope 40 for adjustment in length, the string 50 must comes out of rope 40 in front of any knot or tie of rope 40.

The descriptions and illustrations mentioned above are those of the most preferred embodiments of this invention and no unnecessary limitations should be understood therefrom as modification will be obvious to those skilled in the art.

I claim:

1. An all-occasion jumping rope comprising two handles, two freely rotatable holders inside said handles and retained in place by a retaining means, a flexible rope attached at each end of said rope to said holders by an attaching means, a flexible string freely slidable inside said rope also attached at its ends to said holders by an attaching means, and at least one of said holders comprising means to adjust the length of said flexible string held on said holders to thereby change the length of said flexible rope between said handles.

2. An all-occasion jumping rope according to claim 1, wherein said handles comprises a tube with one open end, and with the other end being closed except for a center hole, said closed end acting as the holder retaining means.

3. An all-occasion jumping rope according to claim 2, wherein, at least one of said holders comprises a tube and a joined body; said tube extending into said center hole of said handle;

said tube having a hole in the middle to allow said string with or without said rope to pass through;

said body having two holes and three notches;

said string winding or un-winding around two combination sets of said three notches of said body to change the length of said rope; and said holders freely rotating inside said handles; and wherein said means to adjust the length of said string to change the length of said rope is accomplished by pushing the lower end of said tube on said holder to come out of the open end of said handle to perform winding or un-winding of said string on said notches; and then, pushing said holder back into position.

4. An all-occasion jumping rope according to claim 3, wherein said attaching means of said rope comprises passing an end of said rope through said hole in said tube of said holder and tying a knot on the end of said rope, said knot being adjacent the end of said tube of said holder which is adjacent said joined body; and said string coming out of said rope adjacent said knot.

5. An all-occasion jumping rope according to claim 3, wherein said attaching means of said rope comprises passing an end of said rope through said hole in said tube of said holder and tying said rope around said two holes after passing through the end of said tube of said holder which is adjacent said joined body; and said string coming out of said rope adjacent said knot.

6. An all-occasion jumping rope according to claim 3, wherein said attaching means of said rope comprises tying a knot on said rope spaced from an end to be attached, passing the end of the rope through said hole in said tube of said holder and tying said rope around said two holes after passing through the end of said tube of said holder which is adjacent said joined body; and said string coming out of said rope adjacent said knot.

7. An all-occasion jumping rope according to claim 1, wherein said rope, while in use, is in a shape of corrugation having a plurality of small holes to allow said string to pass through.

8. An all-occasion jumping rope according to claim 1, wherein said rope comprises a plurality of O-rings, each said O-ring having two small holes to allow said string to pass through.

9. An all-occasion jumping rope according to claim 1, wherein said rope is a nylon braided hollow rope to allow said string to pass through.

10. An all-occasion jumping rope according to claim 1, wherein said rope is a coiled rope with or without a spring steel as a core in the cross section of said coiled rope; and said coiled rope allowing said string to pass through.

11. An all-occasion jumping rope according to claim 1, wherein said rope is made of a plurality of O-rings engaging freely into each other in series to form a chain to allow said string to pass through.

12. An all occasion jumping rope comprising two handles, two freely rotatable holders inside said handles and retaining means, a flexible rope attached at each end to said holders by an attaching means, and at least one holder comprising a tube and a joined body;

said tube having a hole in the middle to allow said rope to pass through;

said body having two holes for attaching the rope to the body and three notches and winding the rope around in two different combination sets of said three notches to change the length of the rope between said handles.

* * * * *